United States Patent [19]

Mücke et al.

[11] Patent Number: 4,906,558

[45] Date of Patent: Mar. 6, 1990

[54] COLOR PHOTOGRAPHIC SILVER HALIDE MATERIAL

[75] Inventors: Bruno Mücke, Bergisch-Gladbach; Franz Moll, Leverkusen, both of Fed. Rep. of Germany

[73] Assignee: AGFA-Gevaert Aktiengesellschaft, Leverkusen, Fed. Rep. of Germany

[21] Appl. No.: 257,718

[22] Filed: Oct. 14, 1988

[30] Foreign Application Priority Data

Oct. 28, 1987 [DE] Fed. Rep. of Germany ..... 37364103

[51] Int. Cl.[4] ..... G03C 1/10

[52] U.S. Cl. ..... 430/550; 430/569; 430/600; 430/603; 430/605

[58] Field of Search ..... 430/569, 605, 600, 603, 430/550

[56] References Cited

U.S. PATENT DOCUMENTS 2,642,361 7/1949 Damschroder et al. ..... 430/605

3,442,653 5/1969 Dunn ..... 430/603

*Primary Examiner*—Paul R. Michl

*Assistant Examiner*—T. Neville

*Attorney, Agent, or Firm*—Connolly & Hutz

[57] ABSTRACT

Color photographic silver halide material in which at least one layer contains a silver halide emulsion with 95 to 100 mol % of chloride which has been optimally ripened with a combination of at least one sulphur ripening body and at least one compound of the formula

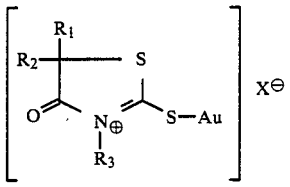

in which $R_1$, $R_2$ and $R_3$ denote, independently of one another, hydrogen or alkyl, and $X^{\ominus}$ denotes an anion, combines excellent sensitivity with low fog and steep gradation, particularly in the threshold and shoulder region.

7 Claims, No Drawings

COLOR PHOTOGRAPHIC SILVER HALIDE MATERIAL

This invention relates to a colour photographic silver halide material which has been chemically sensitized by a particular method, in particular a colour negative paper, containing in at least one layer a silver halide emulsion consisting substantially of silver chloride.

It is known to subject silver halide emulsions to a combined sulphur/gold ripening (e.g. DE-A-22 63 910) for which gold is used in the form of inorganic gold salts. If the silver halide emulsion consists substantially of silver chloride, this treatment results in emulsions which although having sufficient sensitivity only have a flat gradation. The usual methods of increasing the steepness of the gradation, for example doping with rhodium leads to sensitivity losses which are unacceptable, especially in the blue sensitized layer of a colour negative paper since the blue sensitized layer, being normally arranged as the lowermost layer, is in any case disadvantages in its sensitivity compared with the green sensitized and the red sensitized layers.

It was an object of the present invention to provide a colour photographic silver halide material which would combine sufficient sensitivity with steep gradation in all colour layers, at least one colour layer containing a silver halide emulsion consisting substantially of silver chloride.

It has now been found that this problem may be solved by subjecting the silver halide emulsion which consists substantially of silver chloride to a gold/sulphur ripening for which the gold compound is a compound corresponding to the following formula

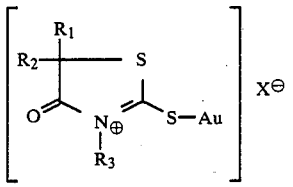

wherein $R_1$, $R_2$ and $R_3$ denote, independently of one another, hydrogen or alkyl and $X\ominus$ denotes an anion, in particular a halide ion, preferably chloride.

This invention therefore relates to a colour photographic silver halide material containing at least one blue sensitive layer having a yellow coupler associated therewith, at least one green sensitive layer having a magenta coupler associated therewith and at least one red sensitive layer having a cyan coupler associated therewith, at least one layer containing a silver halide emulsion in which 95 to 100 mol% of the silver halide is chloride, which silver halide is optimally ripened with a combination of at least one sulphur ripening body and at least one compound corresponding to the following formula

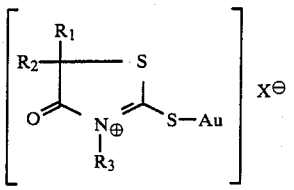

wherein $R_1$, $R_2$ and $R_3$ denote, independently of one another, hydrogen or alkyl, and $X\ominus$ denotes an anion.

The silver halide emulsion which is ripened according to the invention is in particular the blue sensitized emulsion. Preferably all the emulsions contain 95 to 100 mol % of chloride. They also contain from 0 to 5 mol% of bromide, iodide or thiocyanate, singly or in combination, these halides and pseudohalides being preferably used in the following quantities: 0.01 to 0.5 mole% iodide, 0.02 to 5 mol% bromide and 0.02 to 5 mol% thiocyanate.

The sulphur ripening bodies used are generally compounds capable of forming silver sulphide, e.g. thiosulphate, thiourea, thiosemicarbazide or thiocarbamide. They are preferably used in quantities of from 0.5 to 20 μg/g Ag. Thiosulphate is preferred.

In the above formula, $R_1$ and $R_2$ preferably stand for methyl, and $R_3$ for hydrogen. The gold compound may be used in quantities of from 0.5 to 20 μg/g Ag, most preferably from 1 to 10 μg/g Ag.

In another preferred embodiment, the emulsions are doped with iridium in a quantity of from 0.01 to 0.5 μg/g Ag.

Emulsions which have been ripened according to the invention have the desired steep gradation both in the threshold region and in the shoulder region without any loss of sensitivity.

The silver halide may consist predominantly of compact crystals which may be, for example, cubic or octahedral or transitional forms. Platelet shaped crystals may also be present, with an average ratio of diameter of thickness preferably less than 8:1, the diameter of a grain being defined as the diameter of a circle having a surface area equal to the projected area of the grain. The layers may also contain tabular silver halide crystals in which the ratio of diameter of thickness is greater than 8:1.

The silver halide grains may also have a multilayered grain structure which in the simplest case is composed of an inner and an outer grain region (core/shell) which may differ from one another in their halide composition and/or other modifications such as doping. The average grain size of the emulsions is preferably from 0.2 μm to 2.0 μm and the grain size distribution may be either homodisperse or heterodisperse. The emulsions may contain other organic silver salts in addition to silver halide, e.g. silver benzotriazolate or silver behenate.

Two or more types of silver halide emulsions which are prepared separately may be used as mixtures.

The photographic emulsions may be prepared from soluble silver salts and soluble halides by various methods (e.g. P. Glafkides, Chimie et Physique Photographique, Paul Montel, Paris 91967), G.F. Duffin, Photographic Emulsion Chemistry, The Focal Press, London (1966), V.L. Zelikman et al, Making and Coating Photographic Emulsions, The Focal Press, London (1966)).

Precipitation of the silver halide is preferably carried out in the presence of the binder, e.g. gelatine, at an acid, neutral or alkaline pH, preferably with the addition of a silver halide complex former. The latter include compounds such as ammonia, thioethers, imidazole, ammonium thiocyanate and excess halide. The water soluble silver salts and the halides may be brought together either successively by the single jet process or simultaneously by the double jet process or by any combination of the two processes. The components are preferably dosed at increasing flow rates but the "critical" rate of flow which just fails to give rise to fresh nuclei should not be exceeded. The pAg during precipitation may vary within wide limits, the so called pAg controlled process being preferably employed, in which the pAg is kept at a particular, constant value or passes through a particular profile in the course of precipitation. Instead of the preferred method of precipitation with a halide excess, the so called inverse precipitation method with a silver ion excess may be employed. The silver halide crystals may be made to grow not only by precipitation but also by physical ripening (Ostwald ripening) in the presence of excess halide and/or silver halide complex forming agents. The growth of the emulsion grains may in fact take place predominantly as the result of Ostwald ripening, for which a fine grained, so called Lippmann emulsion is preferably mixed with a sparingly soluble emulsion and dissolved and reprecipitated on the latter.

Salts or complexes of metals such as Cd, Zn, Pb, Tl, Bi, Ir, Rh or Fe may be present during precipitation and/or physical ripening of the silver halide grains.

Precipitation may also be carried out in the presence of sensitizing dyes. Complex forming agents and/or dyes may be rendered inactive at any stage, for example by altering the pH or by oxidative treatment.

The binder used is preferably gelatine which may, however, be partly or completely replaced by other synthetic, semisynthetic or naturally occurring polymers. Examples of synthetic gelatine substitutes include polyvinyl alcohol, poly-N-vinyl pyrrolidione, polyacrylamides, polyacrylic acid and derivatives thereof, in particular their copolymers. Examples of naturally occurring gelatine substitutes include other proteins, such as albumin or casein, cellulose, sugar, starch and alignates. Semisynthetic gelatine substitutes are generally modified natural products. Cellulose derivatives such as hydroxyalkyl cellulose, carboxymethyl cellulose and phthalyl cellulose as well as gelatine derivatives obtained by reaction with alkylating or acylating agents or by grafting polymerisable monomers are examples of these semisynthetic substitutes.

The binders should contain a sufficient quantity of functional groups to give rise to sufficiently resistant layers in their reaction with suitable hardeners. Such functional groups are in particular amino groups but also carboxyl groups, hydroxyl groups and active methylene groups.

Gelatine, which is the preferred binder, may be obtained by acid or alkaline decomposition. The gelatine also may be oxidized. The preparation of such gelatines is described, for example, in "The Science and Technology of Gelatine", published by A.G. Ward and A. Courts, Academic Press 1977, page 295 et sec.. The gelatine should be as free as possible from photographically active impurities (inert gelatine). Gelatines with a high viscosity and low tendency to swell are particularly advantageous.

After crystal formation has been completed or even at an earlier stage, the soluble salts are removed from the emulsion, e.g. by shredding and washing, by flocculation and washing, by ultrafiltration or by means of ion exchangers.

The photographic emulsions may contain compounds to prevent fogging or to stabilize the photographic function during preparation, storage or photographic processing.

Particularly suitable compounds are azaindenes, especially tetra and pentaazaindenes, in particular those which are substituted with hydroxyl or amino groups. Compounds of this type are described e.g. by Birr, Z. Wiss. Phot. 47, (1952), pages 2 to 58. Salts of metals such as mercury or cadmium, aromatic sulphonic or sulphinic acid such as benzene sulphinic acid, and nitrogen- containing heterocylic compounds such as nitrobenzimidazole, nitroindazole, (substituted) benzotriazole or benzothiazolium salts may be used as antifoggants. Heterocyclic compounds containing mercapto groups are particularly suitable, e.g. mercaptobenzothiazoles, mercaptoenzimidazoles, mercaptotetrazoles, mercaptothiadiazoles and mercaptopyrimidines. These mercapto azoles may also contain a group which confers solubility in water, e.g. a carboxyl group or a sulpho group. Other suitable compounds are published in Research Disclosure No. 17643 (1978), section VI.

The stabilizers may be added to the silver halide emulsions before, during or after ripening. The compounds may, of course, also be added to other photographic layers which are associated with a silver halide layer.

Mixtures of two or more of the above mentioned compounds may be used.

The photographic emulsion layers or other hydrophilic colloid layers of the light sensitive material prepared according to the invention may contain surface active agents for various purposes, such as coating auxiliaries and substances to prevent electric charging, to improve the antifriction properties, to emulsify the dispersion, to prevent sticking and to improve the photographic characteristics (e.g. development acceleration, high contrast, sensitization, etc.).

The photographic emulsions may be spectrally sensitized with methine dyes or other dyes. Cyanin dyes, merocyanine dyes and complex merocyanine dyes are particularly suitable.

Sensitizers may be dispensed with if the intrinsic sensitivity of the silver halide is sufficient for a particular spectral region, for example the blue sensitivity of silver bromide.

Colour photographic materials normally contain at least one red sensitive, one green sensitive and one blue sensitive emulsion layer, Non-diffusible monomeric of polymeric colour couplers are associated with these emulsion layers and may be present either in the same layer or in an adjacent layer. The red sensitive layers generally have cyan couplers associated with them, the green sensitive layers, magenta couplers, and the blue sensitive layers, yellow couplers.

Colour couplers for producing the cyan partial colour image are generally couplers of the phenol or α-naphthol series. Suitable examples are known in the literature.

Colour couplers for producing the yellow partial colour image are generally couplers containing an open chain ketomethylene group, in particular couplers of the type of α-acyl acetamides. Suitable examples of these couplers are α-benzoyl acetanilide couplers and α-pivaloyl acetanilide couplers, which are also known in the literature.

Colour couplers for producing the magenta partial colour image are generally couplers for the type of 5-pyrazolone, indazolone or pyrazoloazole. Numerous suitable examples of these compounds have been described in the literature.

The colour couplers may be 4-equivalent couples or 2-equivalent couplers. The latter are derived from 4-equivalent couplers in that they contain a substituent in the coupling position, which substituent is split off in the coupling reaction. 2-equivalent couplers include both colourless couplers and couplers which have intense colour of their own which disappears in the process of colour coupling to be replaced by the colour of the image dye produced (masking couplers), as well as white couplers which mainly give rise to colourless products when they react with colour developer oxidation products. The 2-equivalent couplers also include couplers which contain a releasable group in the coupling position, this group being released in the reaction with colour developer oxidation products to unfold a particular desired photographic activity, e.g. as development inhibitor or accelerator, either directly or after one or more additional groups have been split off from this releasable group (e.g. DE-A-27 03 145, De-A-28 55 697, DE-A-31 05 026 and DE-A-33 19 428). The known DIR couplers as well as DAR and FAR couplers are examples of such 2-equivalent couplers.

Since the DIR, DAR and FAR couplers are required mainly for the activity of the group which is released in the coupling reaction and the colour forming properties of these couplers are less important, DIR, DAR and FAR couplers of the type which mainly give rise to colourless products in the coupling reaction are also suitable (DE-A-1 547 640).

The group which is released may also be a ballast group so that the reaction with colour developer oxidation products gives rise to coupling products which are diffusible or at least have a certain, if limited mobility (US-A-4 420 556). High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40-376, EP-A-27 284 and US-A-4 080 211. The high molecular weight colour couplers are generally prepared by the polymerisation of ethylenically unsaturated monomeric colour couplers but they may also be obtained by polyaddition or polycondensation.

Incorporation of the couplers or other compounds in silver halide emulsion layers may be carried out by first preparing a solution, dispersion or emulsion of the compound and then adding this to the casting solution for the layer in which it is required. The choice of suitable solvents and dispersing agents depends on the particular solubility of the compound.

Methods of introducing compounds which are substantially insoluble in water by grinding them are described, for example, in DE-A-2 609 741 and DE-A-2 609 742.

Hydrophobic compounds may also be introduced into the casting solution by means of high boiling solvents, so called oil formers. Methods are described, for example, in US-A-2 322 027, US-A-2 801 170, US-A-2 801 171 and EP-A-0 043 037.

So called polymeric oil formers, which may be oligomers or polymers, may be used instead of the high boiling solvents.

The compounds may also be introduced into the casting solution in the form of charged latices; see, for example, DE-A-2 541 230, DE-A-2 541 274, DE-A-2 835 856, EP-A-0 014 921, EP-A-0 069 671, EP-A-0 130 115 and US-A-4 291 113.

Incorporation of anionic, water soluble compounds (e.g. dyes) in a diffusion fast form may also be achieved by means of cationic polymers, so called mordant polymers.

Examples of suitable oil formers include phthalic acid alkyl esters, phosphoric acid esters, citric acid esters, benzoic acid esters, alkylamides, fatty acid esters and trimesic acid esters.

The colour photographic material typically contains at least one red sensitive emulsion layer, at least one green sensitive emulsion layer and at least one blue sensitive emulsion layer on a support. The order in which these layers are arranged may be varied as desired. Couplers giving rise to cyan, magenta and yellow dyes are generally incorporated in the red, green and blue sensitive emulsion layers respectively but different combinations may also be used.

Each of the light sensitive layers may consist of a single layer or it may be composed of two or more silver halide emulsion partial layers (DE-C-1 121 470). Red sensitive silver halide emulsion layers are frequently arranged closer to the layer support than green sensitive silver halide emulsion layers which in turn are arranged closer to the layer support than blue sensitive layers and a light insensitive yellow filter layer is generally placed between the green sensitive layers and blue sensitive layers.

If the green sensitive or red sensitive layer has a sufficiently low intrinsic sensitivity, the yellow filter layer may be dispensed with and other layer arrangements may be used in which, for example, the blue sensitive layers are placed on the layer support, followed by the red sensitive layers which in turn are followed by the green sensitive layers.

The light insensitive interlayers generally placed between layers which differ in their spectral sensitivity may contain substances for preventing accidental diffusion of developer oxidation products from one light sensitive layer to another light sensitive layer of a different spectral sensitization.

When several partial layers of the same spectral sensitation are present in a material, these may differ from one another in their composition, in particular in the nature and quantity of the silver halide grains. The partial layer with the higher sensitivity is generally arranged further away from the support than the less sensitive partial layer. Partial layers of the same spectral sensitization may be adjacented to one another or separated by other layers, e.g. by layers of a different spectral sensitization. Thus, for example, all highly sensitive layers may be combined to form a layer packet and all low sensitivity layers may be combined to form another layer packet (DE-A 1 958 709, DE-A 2 530 645, DE-A 2 622 922).

The photographic material may also contain UV light absorbing compounds, white toners, solid particles, filter dyes, formalin acceptors and other substances.

UV light absorbent compounds serve to protect the image dyes against bleaching by daylight rich in UV light and as filter dyes they also serve to absorb the UV light present in the daylight used for exposure, thereby improving the colour reproduction of the film. Compounds of different structures are usually used for these two purposes. Examples of UV light absorbent compounds include aryl-substituted benzotriazole compounds (US-A 3 533 794), 4-thiazolidone compounds (US-A 3 314 794 and 3 352 681), benzophenone compounds (JP-A 2784/71), cinnamic acid ester compounds (US-A 3 705 805 and 3 707 375), butadiene compounds (US-A 4 045 229) and benzoxazole compounds (US-A 3 700 455).

Ultraviolet absorbent couplers (such as cyan couplers of the α-naphthol series) and ultraviolet absorbent polymers may also be used. These ultraviolet absorbents may be fixed in a particular layer by mordanting.

Filter dyes suitable for visible light include oxonole dyes, hemioxonole dyes, styrene dyes, merocyanine dyes, cyanine dyes and azo dyes. Among these dyes, oxonole dyes, hemioxonole dyes and merocyanine dyes are particularly advantageous.

Suitable white toners are described, for example, in Research Disclosure, December 1978, page 22 et sec, number 17 643, chapter V.

Certain layers of binder, in particular the layer furthest removed from the support but occasionally also an interlayer, especially if it is the layer furthest removed from the support during the process of preparation, may contain photographically inert particles of an inorganic or organic nature, e.g. as matting agents or as spacers (DE-A 3 331 542, DE-A 3 424 893, Research Disclosure December 1978, page 22 et sec, Report No. 17 643, chapter XVI).

The average particle diameter of the solid particles may be in the range of from 0.2 to 10 μm. The particles are water insoluble and may be either soluble or insoluble in alkalis. If they are soluble in alkalis, they are generally removed from the photographic material in the alkaline development bath. Examples of suitable polymers include polymethyl methacrylate, copolymers of acrylic acid and methyl methacrylate and hydroxy propyl methyl cellulose hexahydrophthalate.

The binder of the material according to the invention, especially gelatine, is hardened with suitable hardeners, for example with hardeners of the type of epoxies, ethylene imine, acryloyl or vinyl sulphone. Hardeners of the diazine, triazine and 1,2-dihydroquinoline series are also suitable.

The binders of the material according to the invention are preferably hardened with instant hardeners.

Instant hardeners are compounds which cross-link suitable binders at such a rate that hardening has been completed to such an extent immediately after casting or at latest after 24 hours, preferably after not more than 8 hours, that no further change in sensitometry or swelling of the combination of layers will take place as the results of a cross-linking reaction. The swelling is taken to be the difference between the wet layer thickness and the dry layer thickness when a film is processed under aqueous conditions (Photogr. Sci. Eng. 8 (1964), 275; Photogr. Sci. Eng. (1972), 449).

These hardeners which react very rapidly with gelatine may be, for example, carbamoylpyridinium salts which are capable of reacting with free carboxyl groups present in the gelatine so that the carboxyl groups will react with free amino groups of the gelatine to form peptide bonds and effect cross-linking of the gelatine.

Suitable examples of instant hardeners include, for example, compounds corresponding to the following general formulae:

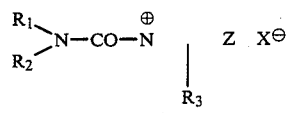

(a)

wherein $R_1$ denotes alkyl, aryl or aralkyl, $R_2$ has the same meaning as $R_1$ or denotes alkylene, arylene, aralkylene or alkaralkylene and the second bond is linked with a group of the formula

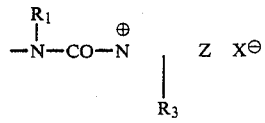

or $R_1$ and $R_2$ together represent the atoms required for completing an optionally substituted heterocyclic ring, for example a piperidine, piperazine or morpholine ring, which ring may be substituted, for example by $C_1$ to $C_3$ alkyl or halogen, $R_3$ stands for hydrogen, alkyl, aryl, alkoxy, $—NR_4—COR_5$, $—(CH_2)_m—NR_8R_9$, $—(CH_2)_n—CONR_{13}R_{14}$ or $—(CH_2)_p—$

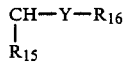

or a briding member or a direct bond attached to a polymer chain, and $R_4$, $R_6$, $R_7$, $R_{14}$, $R_{15}$, $R_{17}$, $R_{18}$ and $R_{19}$ stand for hydrogen or $C_1$ to $C_4$ alkyl, $R_5$ denotes hydrogen, $C_1$ to $C_4$ alkyl or $NR_6R_7$, $R_8$ denotes $COR_{10}$, $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m stands for a number from 1 to 3, n stands for a number from 0 to 3, p stands for a number from 2 to 3 and Y stands for O or $NR_{17}$ or $R_{13}$ and $R_{14}$ together represent the atoms required for completing an optionally substituted heterocyclic ring, for example a piperidine, piperazine or morpholine ring, which ring may be substituted, for example with $C_1$ to $C_3$ alkyl or halogen, Z denotes the carbon atoms required for completing a 5- or 6-membered aromatic heterocyclic ring, optionally with a condensed benzene ring attached, and $X^{\ominus}$ denotes an anion, which is not present when an anionic group is already attached to the remainder of the molecule:

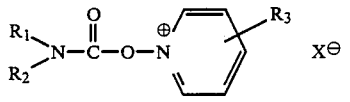

(b)

wherein $R_1$, $R_2$, and $R_3$ and $X\ominus$ have the meanings given for formula (a).

The materials according to the invention, which may be colour negative or colour reversal films, colour negative paper or colour reverse paper or direct positive materials, are processed by the usual methods recommended for these materials.

Preparation of gold dimethyl rhodanine.

1.28 g of dimethyl rhodanine corresponding to the following formula

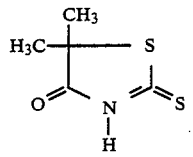

are dissolved in 400 ml of methanol. The solution is diluted to 800 ml with water and cooled to 15° C. To this solution are added 2 ml of a 40% by weight aqueous solution of $AuCl_3$. HCl with stirring. The precipitate is filtered, washed once with methanol and twice with water at 15° C. and dried at room temperature in a desiccator over silicagel.

Preparation of the emulsion.

A 3 molar aqueous solution of $AgNO_3$ and an aqueous solution of the required halide or halides are introduced by double inflow at a constant pAg of 7.7 into a reaction vessel at 50° C. with stirring. $Na_2IrCl_6$ is added to the halide solution. The halide compositions used in each case are shown in the following table, in which bromide is used as KBr, iodide as KI, chloride as KCl and thiocyanate as KSCN.

coupler, 27.7 mg of 2,5-dioctylhydroquinone and 650 mg of tricresyl phosphate.

The emulsion was prepared by double inflow to produce an average grain size of 0.8 μm, flocculated in the usual manner, washed and redispersed with gelatine. The ratio by weight of gelatine to silver (as $AgNO_3$) was 0.5. The emulsion was then ripened to optimum sensitivity with 15 μmol of thiosulphate and 1 μmol of gold thiosulphate per mol of Ag, sensitized to the blue spectral region and stabilized.

4. An interlayer of 1200 mg of gelatine, 80 mg of 2,5-dioctylhydroquinone and 100 mg of tricresyl phosphate.

5. A green sensitive silver chlorobromide emulsion layer (99 mol% chloride) of 530 mg of $AgNO_3$ containing 750 mg of gelatine, 0.625 mmol of magenta coupler, 118 mg of α-(3-t-butyl-4-hydroxyphenoxy)-myristic acid ethyl ester, 43 mg of 2,5-dioctylhydroquinone, 343 mg of dibutyl phthalate and 43 mg of tricresyl phosphate (average grain size 0.4 μm, ripening: 20 μmol thiosulphate +5 μmol gold thiosulphate per mol Ag).

6. An interlayer of 1550 mg of gelatine, 285 mg of a UV absorbent corresponding to the following formula

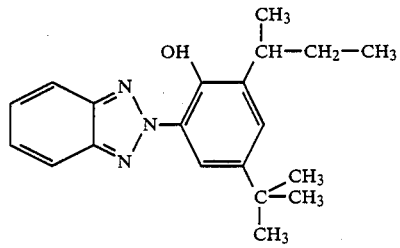

80 mg of dioctylhydroquinone and 650 mg of tricresyl phosphate.

7. A red sensitive silver chlorobromide emulsion layer (99 mol% chloride) of 400 mg of $AgNO_3$ containing 1470 mg of gelatine, 0.780 mmol of cyan coupler, 285 mg of dibutyl phthalate and 122 mg of tricresyl

| Example No. | Composition of Emulsion in mol % AgCl | AgBr | AgI | Doping μmol/mol Ag $Na_2IrCl_6$ | Ripening Additive in μmol/mol Ag $Na_2S_2O_3$ | $HAuCl_4$ | KSCN | $Na_3[Au(S_2O_3)_2]$ | Au-rhodanine | Sensitometry log I.t | $D_{min}$ | G1 | G2 |
|---|---|---|---|---|---|---|---|---|---|---|---|---|---|
| 1 | 99 | 1 | — | 0.03 | 15 | 1.0 | 10 | — | — | 1.95 | 0.145 | 1.61 | 3.15 |
| 2 | 99.9 | — | 0.1 | 0.03 | 15 | 1.1 | 11 | — | — | 1.98 | 0.139 | 1.65 | 3.21 |
| 3 | 99.5 | — | 0.5 | 0.03 | 15 | — | — | 1 | — | 1.92 | 0.141 | 1.59 | 3.08 |
| 4 | 99 | 1 | — | 0.03 | 15 | — | — | — | 4 | 1.99 | 0.135 | 2.05 | 5.20 |
| 5 | 99.9 | — | 0.1 | 0.03 | 15 | — | — | — | 3 | 1.93 | 0.140 | 1.98 | 4.92 |
| 6 | 99 | 1 | — | 0.2 | 14 | — | — | — | 7 | 2.11 | 0.114 | 2.10 | 5.23 |

G1 = threshold gradation
G2 = shoulder gradation

EXAMPLE 1

The following layers were applied to a layer support which was coated with polyethylene on both sides. The quantities given are based on 1 $m^2$.

1. A substrate layer of 200 mg of gelatine with an addition of $KNO_3$ and chrome alum.

2. An adhesive layer of 320 mg of gelatine.

3. A blue sensitive silver chlorobromide emulsion layer (99 mol% chloride) composed of 450 mg of $AgNO_3$ with 1600 mg of gelatine, 1.0 mmol of yellow phosphate (average grain size 0.3 μm, ripening: 20 μmol thiosulphate +8 μmol gold thiosulphate per mol Ag).

8. A protective layer of 1200 mg of gelatine, 134 mg of a UV absorbent as in the sixth layer and 240 mg of tricresyl phosphate.

9. A hardening layer of 400 mg of gelatine and 400 mg of a hardener corresponding to the following formula

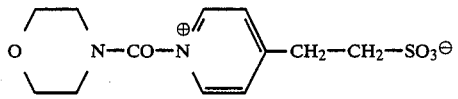

The following compounds were used as colour couplers:

Yellow coupler:

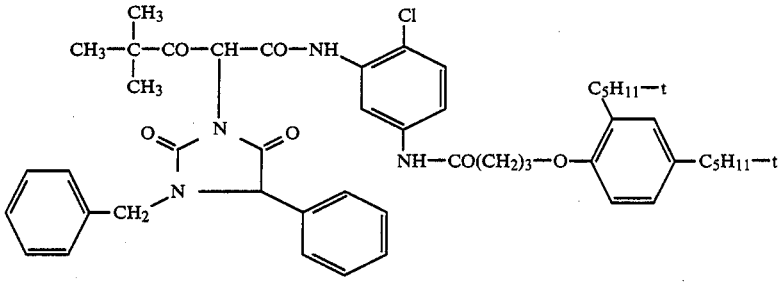

Magenta coupler:

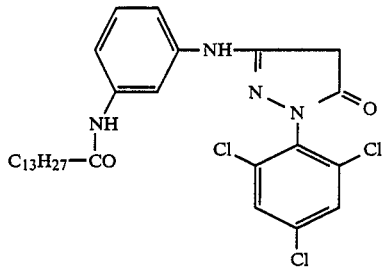

Cyan coupler:

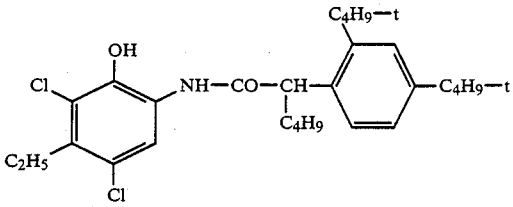

The material obtained was marked sample 1.

Another material was prepared in analogous manner but ripening of the blue sensitive emulsion was carried out with 15 μmol of thiosulphate and 7 μmol of gold compound corresponding to the following formula

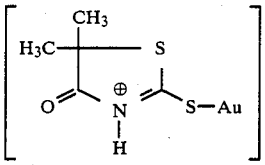

$Cl^{\ominus}$ (gold dimethyl rhodanine), ripening of the green sensitive emulsion was carried out with 20 μmol of thiosulphate and 15 μmol of gold thiocyanate and ripening of the red sensitive emulsion was carried out with 20 μmol of thiosulphate and 18 μmol of gold thiocyanate (sample 2).

The material was processed by the Ektacolour-RA-4 process using chemicals recommended for this process (manufacturers Kodak).

The following table shows above all the steeper gradation in the threshold region and the shoulder region (G1, G2) while the sensitivity is shown to be somewhat improved and fogging almost unchanged.

| Sample No. | Emulsion | Log It | D min | G1 | G2 |
|---|---|---|---|---|---|
| 1 | Yellow | 1.55 | 0.135 | 1.65 | 2.55 |
| | Magenta | 1.55 | 0.116 | 1.67 | 2.68 |
| | Cyan | 1.55 | 0.109 | 1.68 | 2.70 |
| 2 | Yellow | 1.60 | 0.131 | 1.93 | 3.15 |
| | Magenta | 1.61 | 0.115 | 1.91 | 3.29 |
| | Cyan | 1.61 | 0.108 | 1.85 | 3.35 |

What is claimed is:

1. Photographic silver halide material containing at least one blue sensitive layer with which a yellow coupler is associated, at least one green sensitive layer with which a magenta coupler is associated and at least one red sensitive layer with which a cyan coupler is associated, at least one layer containing a silver halide emulsion in which from 95 to 100 mol% of the halide is chloride, which emulsion is ripened to optimum sensitivity with a combination of at least one sulphur ripening compound and at least one compound corresponding to the following formula

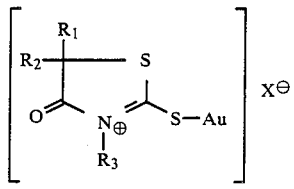

wherein $R_1$, $R_2$ and $R_3$ denote, independently of one another, hydrogen or alkyl and $X^{\ominus}$ denotes an anion.

2. Colour photographic material according to claim 1, in which the blue sensitive layer or blue sensitive layers is or are optimally ripened with a sulphur ripening compound and a gold command according to claim 1.

3. Colour photographic material according to claim 1, in which the silver halide emulsion containing from 95 to 100 mol% of chloride is doped with iridium.

4. Colour photographic material according to claim 1, in which all the emulsions consists to an extent of 95 to 100 mol% of chloride.

5. Colour photographic material according to claim 1, in which the silver halide emulsion which consists substantially of chloride contains from 0.01 to 0.5 mol% of iodide or from 0.02 to 5 mol% of bromide or from 0.02 to 5 mol% of thiocyanate.

6. Colour photographic material according to claim 1, in which the sulphur ripening compound is used in a quantity of from 0.5 to 20 μg/g of Ag and the gold compound is used in a quantity of from 0.5 to 20 μg/g of Ag.

7. Colour photographic material according to claim 1, in which the sulphur ripening compound used is thiosulphate and the gold compound used is a compound in which $R_1$, $R_2$ = methyl, $R_3$ = hydrogen and $X^{\ominus}$ = chloride.

* * * * *